US007594586B2

(12) United States Patent
Cai

(10) Patent No.: US 7,594,586 B2
(45) Date of Patent: Sep. 29, 2009

(54) VACUUM GENERATING DEVICE FOR SEALING PERISHABLE PRODUCTS AND METHOD OF USE

(76) Inventor: Edward Z. Cai, 4607 SE. Autumn Ct., Camas, WA (US) 98607

( * ) Notice: Subject to any disclaimer, the term of this patent is extended or adjusted under 35 U.S.C. 154(b) by 260 days.

(21) Appl. No.: 11/499,280

(22) Filed: Aug. 5, 2006

(65) Prior Publication Data

US 2008/0041852 A1 Feb. 21, 2008

(51) Int. Cl.
*B65D 41/01* (2006.01)
*B65D 51/00* (2006.01)

(52) U.S. Cl. ..... 220/287; 220/366.1; 220/806; 220/231; 220/796

(58) Field of Classification Search ..... 220/231, 220/287, 796, 806, 366.1
See application file for complete search history.

(56) References Cited

U.S. PATENT DOCUMENTS 1,651,669 A * 12/1927 Carpmael ..... 215/316
3,055,536 A * 9/1962 Dieny ..... 220/203.11
3,559,843 A * 2/1971 Kern ..... 220/281
3,901,405 A * 8/1975 Norberg ..... 220/287
3,982,656 A 9/1976 Kusmierski et al.
4,051,971 A 10/1977 Saleri et al.
4,098,404 A 7/1978 Markert
4,142,645 A 3/1979 Walton
4,201,030 A 5/1980 Mahaffy et al.
4,348,455 A 9/1982 Clayton
4,612,221 A 9/1986 Biel et al.
4,803,468 A * 2/1989 Seifert ..... 340/566
5,006,398 A 4/1991 Banerji
5,112,674 A 5/1992 German et al.
5,213,230 A * 5/1993 Kral ..... 220/580
5,390,809 A 2/1995 Lin (Continued)

OTHER PUBLICATIONS http://www.foodsaver.com.

*Primary Examiner*—Anthony D Stashick
*Assistant Examiner*—James N Smalley

(57) ABSTRACT

A vacuum sealing device comprises a lid having a rigid rim with a lower opening for receiving a dish, an impermeable elastic membrane peripherally affixed to the rigid rim for sealing the dish, and a valve-less air evacuator formed between the elastic membrane and the dish rim. The valve-less evacuator allows air to flow out of the dish when the lid is being pressed and becomes closed when the lid is released to cause said lid to rebound to form a vacuum in the dish. The rigid rim prevents lid deformation when the lid is pressed, thus enabling the vacuum formation. To facilitate lid removal, the device has a valve-less vacuum releaser comprising a finger-receiving chamber and a section of the elastic membrane located above the chamber and connected to the rigid rim for releasing the vacuum in the dish. To prevent vacuum loss during storage in freezer or fridge, the elastic membrane is sufficiently thinned prior to being affixed to the rigid rim. In use, one places the lid on a dish, forces air out of the dish via the air evacuator between a section of the elastic membrane and the dish rim by pressing the lid, and releases the lid to cause the air evacuator to close and vacuum to form in the dish. To restore the device's capability to generate and maintain vacuum after numerous uses, the lid is exposed to a hot fluid having a temperature higher than 45° C. for a period of time.

27 Claims, 8 Drawing Sheets

U.S. PATENT DOCUMENTS 5,428,943 A 7/1995 Balcombe
5,546,997 A 8/1996 Miramon
5,555,705 A 9/1996 Balcombe
5,638,971 A 6/1997 Justesen
5,779,082 A 7/1998 Miramon
5,806,704 A 9/1998 Jamison
5,871,120 A 2/1999 Romero et al.
5,893,822 A 4/1999 Deni et al.
5,954,215 A 9/1999 Alter
5,974,686 A 11/1999 Nomura et al.
6,035,769 A 3/2000 Nomura et al.
6,148,875 A 11/2000 Breen
6,194,011 B1 2/2001 Glaser
6,206,220 B1 3/2001 Stodd
6,260,729 B1 * 7/2001 Mitchell et al. ..... 220/287
6,264,054 B1 7/2001 Miyake et al.
6,353,067 B1 3/2002 Kameyama et al.
6,478,218 B1 11/2002 Boatwright et al.
6,482,532 B1 11/2002 Yap et al.
6,582,743 B2 6/2003 Cai
6,675,560 B2 1/2004 Gott et al.
6,732,874 B2 5/2004 Zilberman
6,763,857 B2 7/2004 Brown
7,051,895 B2 5/2006 Toussant et al.
7,299,941 B2 * 11/2007 McMahon et al. ..... 220/780
2004/0045862 A1 3/2004 Zilberman
2004/0155041 A1 8/2004 Kwon
2004/0159661 A1 8/2004 Aochi
2004/0177771 A1 9/2004 Small et al.
2004/0251256 A1 12/2004 Turvey et al.
2006/0151511 A1 7/2006 Kaposi
2008/0073366 A1 * 3/2008 Backaert ..... 220/785

* cited by examiner

VACUUM GENERATING DEVICE FOR SEALING PERISHABLE PRODUCTS AND METHOD OF USE

FIELD OF THE INVENTION

This invention relates to a vacuum generating device for perishable products such as food, and is an improvement for the applicant's U.S. patent application Ser. No. 10/917,016.

BACKGROUND OF THE INVENTION

In commercial and home vacuum packaging, food is often placed in a plastic vacuum bag and the bag is subsequently evacuated and sealed by a vacuum seal appliance such as FoodSaver® or Seal-a-Meal® sealer. For average homes, such method is too labor intensive and complex for daily food storage. Moreover, the vacuum bag is normally disposed after one use, which is expensive and not environment friendly.

It is also known to place food in a vacuum container and evacuate the container either by connecting the vacuum seal appliance to the container lid via a vacuum tube as taught by FoodSaver® or Seal-a-Meal® sealer or by manually removing air via a check valve in the lid as taught by Wang in U.S. Pat. No. 6,557,462. Such vacuum containers are susceptible to air leakage and plugging of the check valve and vacuum release valve in the lid by food. The check valve and vacuum release valve in the lid are also difficult to clean, which is not desirable for food storage.

In the applicant's earlier invention disclosed in U.S. patent application Ser. No. 10/917,016, it was taught to seal food in existing kitchen containers with a vacuum lid comprising a rigid ring and an elastic membrane attached to the rigid ring.

The present invention is to provide a new vacuum storage device to simplify the process of sealing food and other spoilable products and to solve the problems with the vacuum storage devices described above.

SUMMARY OF THE INVENTION

The invention provides a vacuum sealing device having a lid for a dish or container adapted to receive the perishable product. The lid comprises a rigid rim having a lower opening for receiving the dish, an impermeable elastic membrane whose peripheral section is connected or affixed to the rigid rim for sealing to the rim of the dish, and a valve-less air evacuator formed between the elastic membrane and the rim of the dish. The rigid rim is made from a sufficiently rigid material to prevent it from being deformed when the lid on the dish is being pressed. The valve-less air evacuator allows the air to flow out of the dish when the lid is being pressed and becomes closed when the lid is released to cause said lid to rebound and the space between said lid and container to expand to form a vacuum in the dish. To facilitate the removal of the lid, the device has a valve-less vacuum releaser comprising a finger-receiving chamber and a section of the elastic membrane located above the finger-receiving chamber and connected to the rigid rim for releasing the vacuum in the dish. The finger-receiving chamber is sufficiently large to allow a finger or finger-like member to pass through and push said elastic seal member to release the vacuum in the dish.

To prevent the sucking-in of the elastic membrane after microwave oven heating and prevent potential crushing of the perishable product in the dish or damaging of the elastic membrane during said sucking-in, at least one protruded section is provided on the elastic membrane or the rim of the dish to cause the lid to tilt sufficiently on the dish. To prevent the loss of vacuum in the dish during the storage of the perishable product in freezers and refrigerators, the elastic membrane is sufficiently thinned prior to being affixed to the rigid rim. In another embodiment of the invention, the elastic membrane may be replaced by a rigid or semi-rigid center section and an elastic seal member between the center section and the outer periphery of the rigid rim.

The present invention further provides a method for using the vacuum generating device by placing said lid on the dish containing a perishable product, forcing air out of the dish via an air evacuator formed between a section of the elastic membrane and the rim of the dish by pressing the lid, and releasing the lid to allow the space between said lid and dish to expand to form a vacuum therein. The method may further comprise releasing the vacuum by placing a finger into the finger-receiving chamber of the valve-less vacuum releaser and pushing the elastic membrane and restoring the lid's capability to generate and maintain vacuum in the dish after the lid is used one or more times by exposing the lid to a hot fluid having a temperature higher than 45° C. for a period of time.

DESCRIPTION OF THE DRAWING

The accompanying drawing illustrates diagrammatically non-limitative embodiment of the invention, as follows.

DETAILED DESCRIPTION OF THE PREFERRED EMBODIMENTS

Figure 1C:
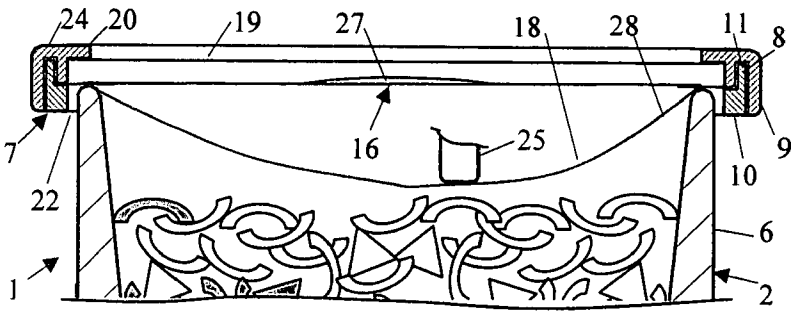
FIG. 1*c* is a section view of the device of FIG. 1 when the lid is being pressed by a hand or finger.
Figure 1A:
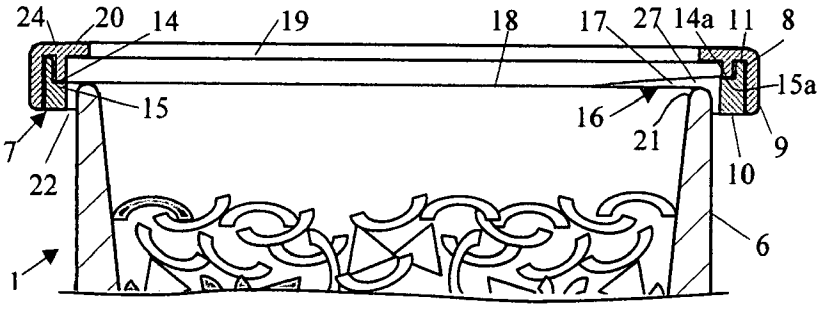
FIG. 1*a* is a section view for the upper part of the device along line A-A of FIG. 1.
Figure 1B:
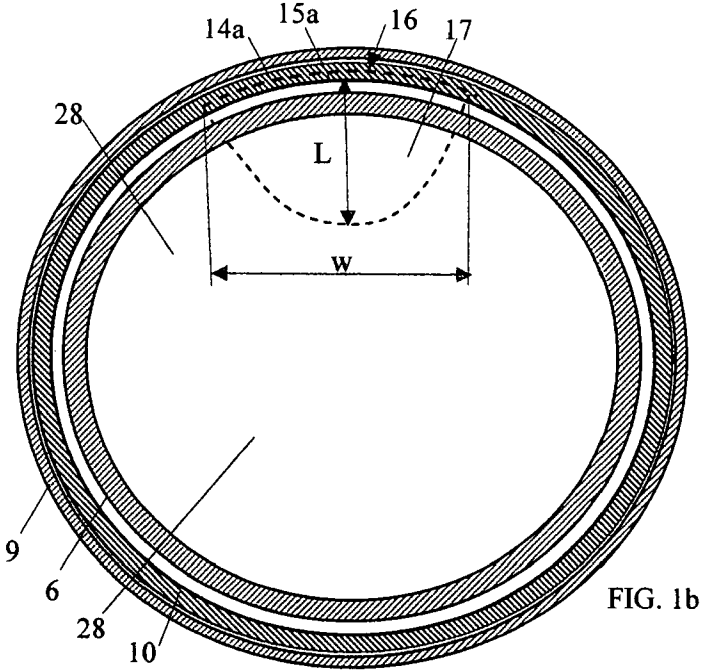
FIG. 1*b* is a section view of the device along line B-B of FIG. 1.
Figure 1:
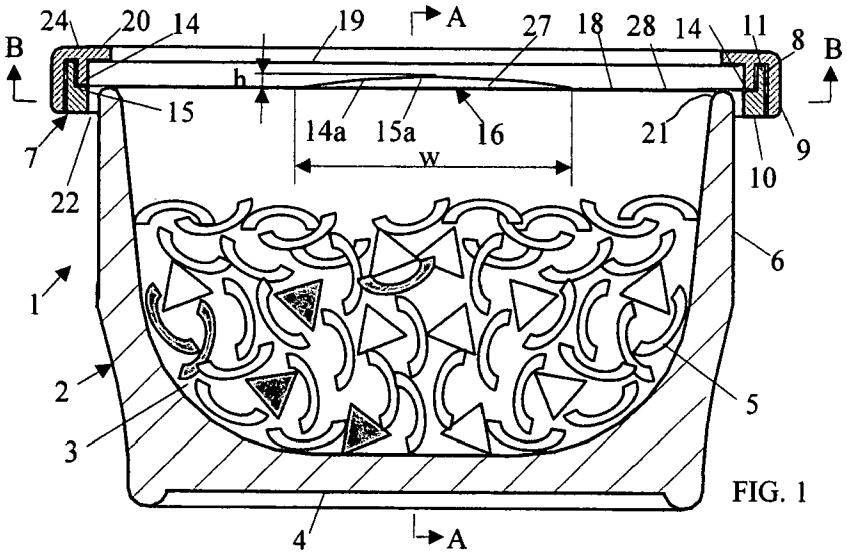
FIG. 1 is a section view of a vacuum generating device having a vacuum lid on a dish before the vacuum is formed.

FIGS. 1-1*b* show a vacuum generating device 1 having a vacuum lid 7 and a dish 2. The dish has a side wall 6, rim 21, bottom 4 and chamber 3 for receiving food 5. Lid 7 has an elastic and air impermeable membrane 18 having an outer seal section 28, a rigid rim 24 for adding strength to the elastic membrane 18 and enabling the membrane to generate vacuum in dish 2, and a valve-less air evacuator 16 formed between the seal section 28 and the rim 21 of dish 2 for releasing the air in the dish when the lid is being pressed and for causing the seal section 28 to seal to the rim 21 to prevent air from entering the dish when the lid is released.

The rigid rim 24 comprises an outer rim 9 having a continuous channel 8 around its peripheral and an inner rim 10 having an upper ridge 11 receivable in channel 8 for sandwiching and affixing the periphery of the seal section 28 between the inner and outer rims. The outer rim 9 further has an upper horizontal ring 20, an upper opening 19 to allow access to the elastic membrane 28, and a bottom-facing inner perimeter 14. The inner rim further has a lower opening 22 to receive or surround the side wall 6 or rim 21 of the dish and a top-facing inner perimeter 15 that fits to the bottom-facing inner perimeter 14 of the outer rim to cause the outer seal section 28 to conform to the contour or topography of the bottom-facing inner perimeter 14 and top-facing inner perimeter 15. The outer rim 9 comprises a rigid material such as metal, glass, ceramics or hard plastics (e.g. polycarbonate, polyester, polyacrylate, polystyrene, polypropylene or polyamide) to lend strength to the elastic membrane 18 and to prevent the rigid rim 24 from deforming when the elastic membrane is pressed downward to the dish 2.

Figure 1D:
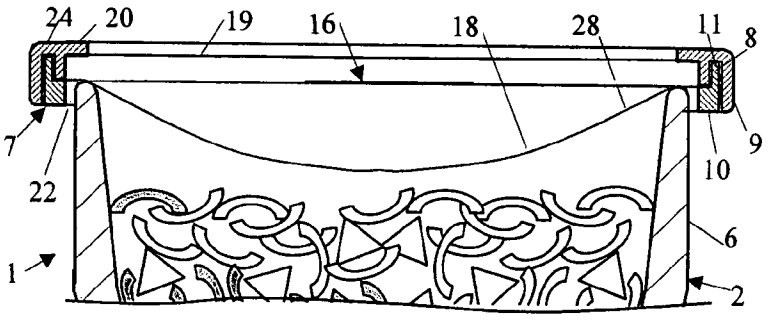
FIG. 1*d* is a section view of the device of FIG. 1*c* after releasing the lid.

As shown in FIGS. 1, 1*a* and 1*b*, the valve-less air evacuator 16 comprises a recessed section 14*a* on the bottom-facing inner perimeter 14 of the outer rim 9 and a protruded section 15*a* on the bottom-facing inner perimeter 15 of the inner rim 10 receivable in the recessed section 14*a* to form a recessed section 17 on the seal section 28 of the lid. The recessed section 17 originates from the recessed section 14*a* and protruded section 15*a* of the rigid rim 24 and extends a distance L into the seal section 28 of the elastic membrane 18 to form an opening 27 between the recessed section 17 and the rim 21 of the dish 2. The opening 27 stays partially open when the lid or elastic membrane is pressed downward by a finger or hand 25 (FIG. 1*c*) to allow air to flow out of the dish. Upon release, the lid or elastic membrane tends to rebound, thus causing the space between the lid and dish to expand and a vacuum to form in the dish. The valve-less air evacuator is self closed to enable sufficient closing of the opening 27 to preserve the vacuum in the dish for an extended period of time (FIG. 1*d*).

To enable the sufficient closure of the valve-less air evacuator 16 after the release of the lid or elastic membrane, it was found that the ratio of the length (w) of the recessed section 14*a* or protruded section 15*a* along the inner perimeter of the rigid rim 24 to the height (h) of the recessed section 14*a* or protruded section 15*a* must be larger than 1. Preferably, the w/h ratio is larger than 5. For example, when h is 1 mm, w must be longer than 1 mm, preferably longer than 5 mm. A valve-less air evacuator with a w/h ratio smaller than 1 was found to cause the loss of the vacuum in dish 2 within days or even hours. It was also found that the thickness of the elastic membrane near the recessed section 17 should be less than about 0.05 inches, preferably less than 0.02 inches.

To allow the valve-less air evacuator to function, the maximum thickness allowed for the elastic membrane 18 was found to be 0.25w or smaller. Long preservation (e.g. three to thirty weeks) of the vacuum in the dish 2 was found to be achieved when the elastic membrane 18 in the vacuum lid was thinner than about 0.01 inches. The elastic membrane 18 may be made from materials such as butyl rubber, nitrile rubber, ethylene acrylic elastomers, ethylene propylene (or EPDM) rubber, natural rubber, polyurethane elastomers, styrene-containing block copolymer elastomers, Santoprene elastomer and polychroroprene elastomer.

When using vacuum device 1, one puts the perishable product 5 into the dish 2, places the lid 7 onto the dish (FIG. 1), and presses the lid or elastic membrane 18 by hand or finger 25 to evacuate the dish (FIG. 1*c*) through the valve-less air evacuator 16. Although the valve-less air evacuator is reduced in size by the pressing of the lid, it is still sufficiently large for air to flow out (FIGS. 1 and 1*c*). By making the w/h ratio larger than 1 and preferably larger than 4, the valve-less evacuator is able to close right after releasing the lid. After the lid is released or not pressed, the elasticity of the elastic membrane tends to cause the lid 7 to move upwards to expand the space between the lid and the dish, thus causing a vacuum to form therein. The closing of the openings 27*a* and 2*b* was found to be sufficient to preserve the vacuum up to weeks and even months.

It is appreciated that without the valve-less evacuator 16, it would be difficult for air to flow out when the lid 7 is pressed and as result the dish 7 would have either very low vacuum or even no vacuum generated therein. The dish may be any container such as a bowl, platter, canister, can, drum, barrel, box, beaker, bottle or pot. The perishable product may be any product whose composition or physical property may be altered by air or the pollutant or particles in air. Such products include dry or wet foods, samples for analysis, chemicals, medicine, mechanical or electronic devices.

Because the device 1 of FIG. 1 enables a consumer to produce a vacuum seal by simply pressing the elastic membrane 18, it not only saves consumers the money to buy expensive vacuum seal appliances but also make the vacuum sealing of food significantly faster and simpler. More importantly, since device 1 evacuates air via valve-less air evacuator 16 between the elastic membrane 18 and the rim 21 of the dish, it does not need any valves for extracting or removing air from the dish as taught in prior art vacuum devices by Saleri et al. in U.S. Pat. No. 4,051,971, Romero et al. in U.S. Pat. No. 5,871,120, Breen in U.S. Pat. No. 6,148,875, Glaser in U.S. Pat. No. 6,194,011 and Wang in U.S. Pat. No. 6,557,462. Such air extraction or removal valves in the prior art vacuum devices comprise a valve opening and a movable valve member that are susceptible to clogging by the solids in food and soup and to insufficient closing of the valve opening by the movable valve member. The valve-less air evacuator, which replaces the air extraction valve in the prior art, has no valve opening or movable valve member and is directly formed on the rim of the dish 2. As a result, the valve-less air evacuator is cleaned every time when the dish is washed, and is thus much less susceptible to clogging or to insufficient closing than the prior art vacuum devices.

Moreover, unlike the prior art devices that contain difficult-to-clean areas such as those in the valve openings or between the valve opening base and valve member, the food in the present device 1 can only contact the lower surface of the elastic membrane 18, which is easy to clean. The difficult-to-clean areas in the prior art devices may allow harmful bacteria to grow and contaminate the food stored therein. Therefore, the present vacuum device 1 provides much more hygienic alternative to the prior art vacuum seal devices.

One of the problems discovered with the present invention of the vacuum device in FIG. 1 is that after heating the device containing food in microwave oven, the elastic membrane 18 of the lid 7 is sometimes completely sucked into the dish 2 and crashed the food therein. In case that the food contains sharp bones or shells, the elastic membrane was found to be weakened or even punctured by the food. The complete sucking-in of the elastic membrane also made it very difficult to remove the lid from the dish 2 after the microwave heating. Such microwave induced sucking-in and crushed food problems were found to occur when the lid 7 was not promptly removed from the dish after the microwave oven heating.

To resolve the microwave induced sucking-in and crushed food problems, a heat activated venting valve (not shown) was initially attached to the elastic membrane 18 of the lid of FIG. 1. The venting valve has a valve opening in communication with a punched opening (not shown) on the elastic membrane and a bi-metal plate that normally seals the valve opening. When the food in the device 1 was heated up, the bi-metal plate deformed and opens up the valve opening to vent the dish. The bi-metal plate remained in the deformed state to vent the dish after microwave heating, thus preventing the elastic membrane from being sucked into the dish and from crashing the food. Unfortunately, the venting valve was frequently found to be clogged or to cause loss of vacuum due to leakage when the food contains soup or liquid.

Figure 2B:
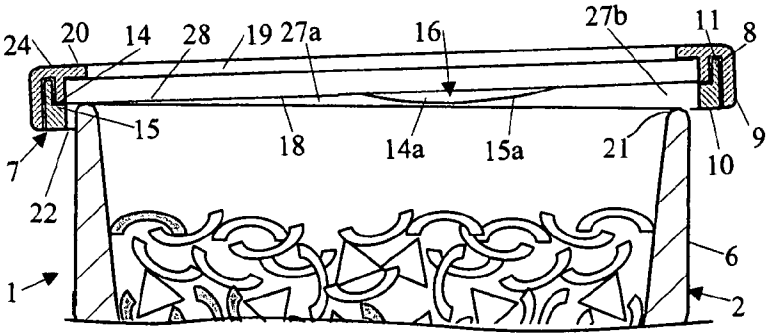
FIG. 2*b* is a section view of the upper part of the device of FIG. 2 when the lid tilts naturally on the dish.
Figure 2A:
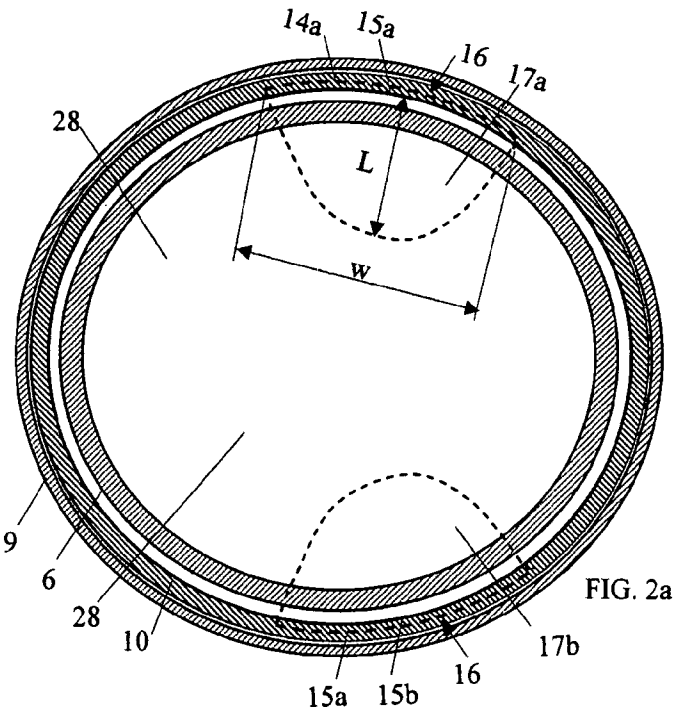
FIG. 2*a* is a section view for the upper part of the device along line A-A of FIG. 2.
Figure 2:
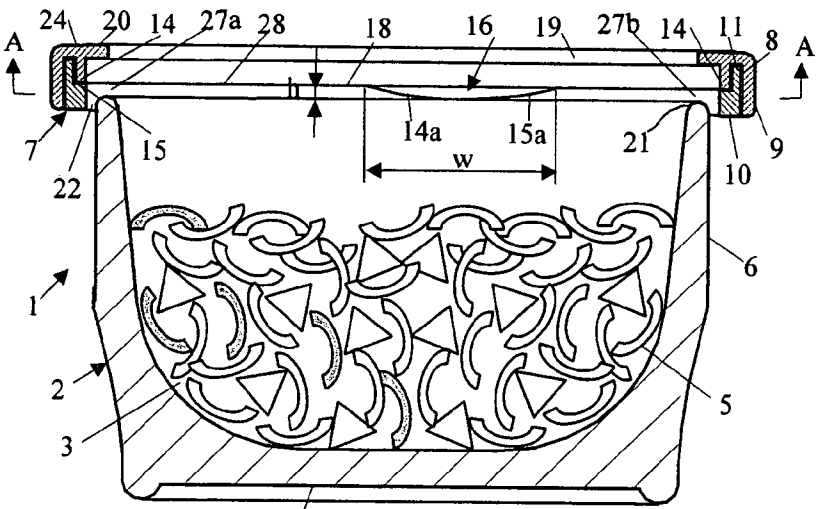
FIG. 2 is a section view of a first modified version for the device of FIG. 1.

An improved version for the lid 7 of FIG. 1 is provided (FIGS. 2, 2*a* and 2*b*) to resolve the microwave induced sucking-in and crushed food problems. In the improved lid 7, the valve-less air evacuator 16 comprises a first protruded section 14*a* on the bottom-facing inner perimeter 14 of the outer rim 9 and a first recessed section 15*a* on the top-facing inner perimeter 15 of the inner rim 10 receivable in the first protruded section 14*a* to form a first protruded section 17*a* on the elastic membrane 18 and a second protruded section 14*b* on the bottom-facing inner perimeter 14 and a second recessed section 15*a* on the top-facing inner perimeter 15 receivable in the second protruded section 14*a* to form a second protruded section 17*a* on the elastic membrane (FIGS. 2 and 2*a*). The protruded sections 17*a* and 17*b* originate from the protruded sections 14*a* and 14*b* of the rigid rim 24, respectively and extends a distance L into the seal section 28 of the elastic membrane 18 to form openings 27*a* and 27*b* between the rim 21 of the dish 2 and the part of the seal section 28 that is lifted up by the two protruded sections 17*a* and 17*b*. Since the first and second protruded sections 17*a* and 17*b* on the seal section 28 of the elastic membrane are located at the left side of the lid, the lid tends to tilt naturally when placed on the dish 2 (FIG. 2*b*). It was found that such tilting of the lid on the dish prevented the elastic membrane from being sucked into the dish and the food from being crashed after microwave oven heating. It is believed that the tilting of the lid 7 on the dish made the opening 27*b* tall enough to prevent the elastic membrane from being sucked into the dish after microwave oven heating.

By adding more mass to the right side of the rigid rim 24, the tilting of the lid 7 might be reversed to make the opening 27*a* taller and the opening 27*b* shorter. Such reversed tilting was discovered to be even more effective in preventing the elastic membrane 18 from being sucked in and the food 5 from being crushed. It was also found that it is possible to enable the lid 7 to tilt on the dish when there is only one protruded section 17*a* or 17*b* formed on the elastic membrane as long as the protruded section 17*a* is sufficiently large, e.g. larger than 20% of the area of the elastic membrane 18. It was further discovered that the microwave sucking-in of the elastic membrane 18 and the crushing of the food 5 might be prevented without tilting the lid 7 if the height h for the recessed section 14*a* in the device 1 of FIG. 1 is larger than 0.5 mm, preferably larger than 1 mm. However, the tilting of the lid 7 was found to be several times more effective against the microwave induced sucking-in and crushed food problems than a deeper or taller recession 14*a*. After all, the recession 14*a* can not be too deep or tall to make the valve-less air evacuator 16 difficult to close. It was the noticed that when the height h of the recessed section 14*a* became larger than 5 to 10 mm the valve-less evacuator became much less capable, if not incapable, to close to preserve the vacuum formed by the lid 7 in the dish.

When the dish 2 used in the device 1 of FIG. 1 or 2 is substantially smaller than the lid 7, it was found that to enable the lid to tilt (FIG. 2*b*) or make the recessed section 14*a* (FIG. 1) taller than 0.5 mm is not sufficient to resolve the microwave induced suck-in and crushed food problems. To prevent the sucking-in and crushed food problems when a smaller diameter dish 2 is used, it was found that the length w of the protruded or recessed section 14*a* should be about 1/32, preferably 1/8, of the perimeter of the lid 7.

Figure 3B:
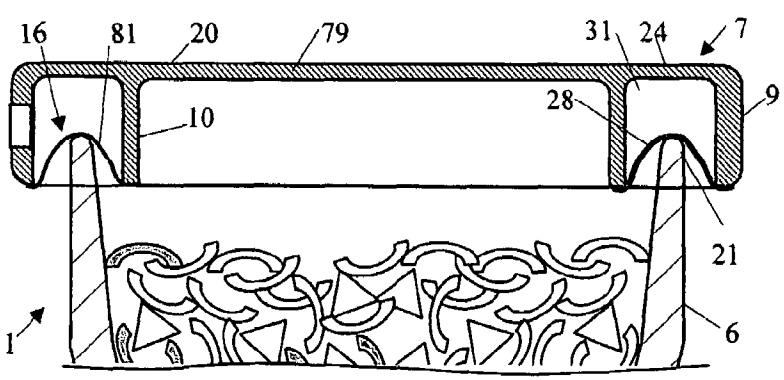
FIG. 3*b* is a section view of the device of FIG. 3*a* after releasing the lid.
Figure 3A:
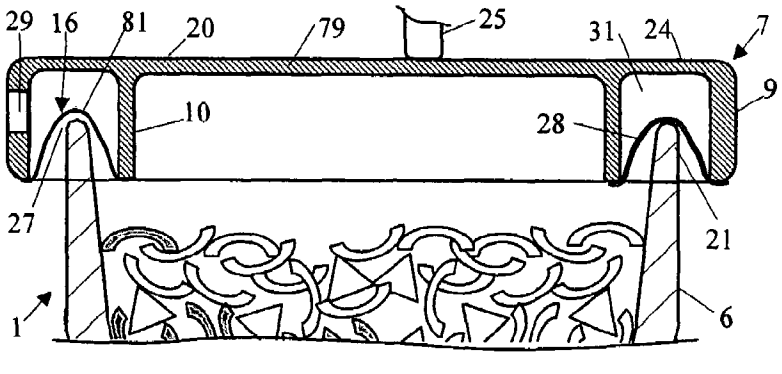
FIG. 3*a* is a section view of the upper part of the device of FIG. 3 when the lid is being pressed by a hand or finger.
Figure 3:
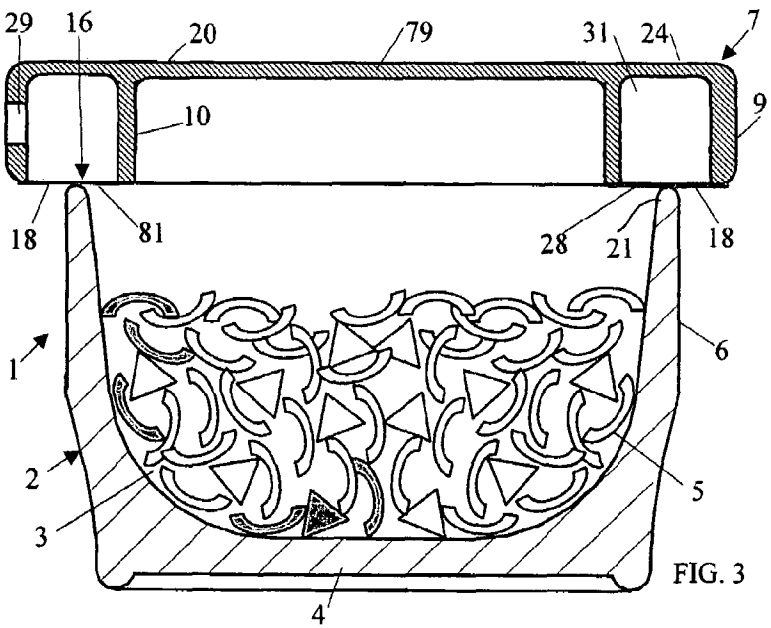
FIG. 3 is a section view of a device having a vacuum lid on a dish before the vacuum is formed according to a second embodiment of the invention.

FIGS. 3, 3*a* and 3*b* provide a second improved version of the lid 7 of FIG. 1 that has a sufficiently rigid center section 79 to prevent the sucking-in and crashed food problems after microwave oven heating. The elastic membrane 18 adopts a ring shape. The inner and outer peripheries of the ring-shaped elastic membrane are attached to the inner rim 10 and outer rim 9, respectively, to form a ring-shaped seal section 28 below the chamber 31 between the inner and outer rims. The valve-less air evacuator 16 comprises a portion 81 of the ring-shaped seal section 28. The elastic membrane in the portion 81 is thinner or easier to stretch, i.e. more stretchable, than the elastic membrane in the rest of the ring-shaped seal section 28. A vacuum facilitating opening 29 is formed on the outer rim 9 for venting the chamber 31 to facilitating the formation of vacuum in the dish 2. Before the lid 7 is pressed, the valve-less air evacuator 16 is closed and there is no gap between the portion 81 of the seal section 28 and the rim 21 of the dish (FIG. 3). When the lid is pressed by a hand or finger 25, the seal section 28 is pushed into the chamber 31 and the air pressure in the dish pushes the thinner or weaker elastic membrane at the portion 81 away from the rim 21 of the dish to form the opening 27 to allow air to flow out of the dish (FIG. 3*a*). The opening 29 lets air out of the chamber 31 to prevent any air pressure to form above the elastic membrane 18. After the lid is released, the elastic membrane 18 tends to return to its natural position, thus causing the space between the lid and dish to expand to form a vacuum and causing the elastic membrane in the portion 81 to seal to the rim 21 of the dish (FIG. 3*b*). Besides lowering the thickness or increasing the stretchability of the elastic film on the portion 81 to produce the valve-less air evacuator 16 when pressing the lid, it was found that providing a recessed or protruded portion on the seal section 28 like that in FIGS. 1 and 2 also produced the valve-less air evacuator. In all cases, since elastic membrane 18 is confined by the chamber 31 and the center section 79 of the lid is sufficiently rigid, this improved lid 7 is not susceptible to the microwave induced sucking-in and crushed food problems.

Figure 4:
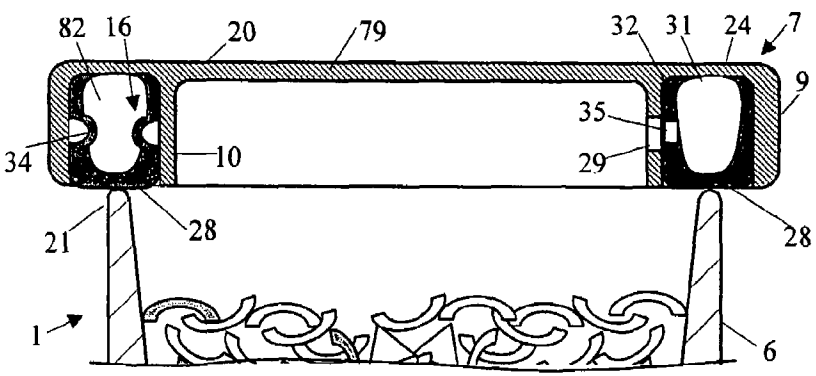
FIG. 4 is a section view of a first modified version for the device of FIG. 3, showing the modified vacuum lid and the upper part of the dish before the vacuum is formed.

FIG. 4 provides a first modified version to the lid 7 of FIG. 3 that has a sufficiently rigid center section 79 to prevent the microwave induced sucking-in and crashed food problems after microwave oven heating. In this lid, the elastic membrane is replaced by a U-shaped seal gasket 32 received in the annular chamber 31. The seal gasket comprises an annular bottom seal section 28, an annular empty chamber 82, and a valve-less air evacuator 16 having an easy-to-compress neck section 34. An opening 35 is formed on the side wall of the gasket 32 in communication with the vacuum facilitating opening 29 to facilitate the compression of the seal gasket. When the lid 7 is pressed, the neck section 34 allows an opening 27 (not shown) to form between the rim 21 of dish 2 and the part of the seal section 28 located below neck section to allow air in the dish to exit. Since the center section 79 of the lid is sufficiently rigid, this improved lid 7 is also not susceptible to the microwave induced sucking-in and crushed food problems.

Figure 5A:
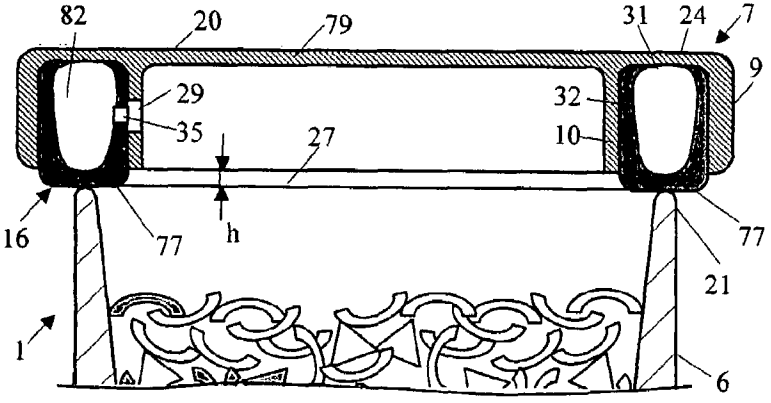
FIG. 5*a* is a section view for the upper part of the device along line A-A of FIG. 5.
Figure 5B:
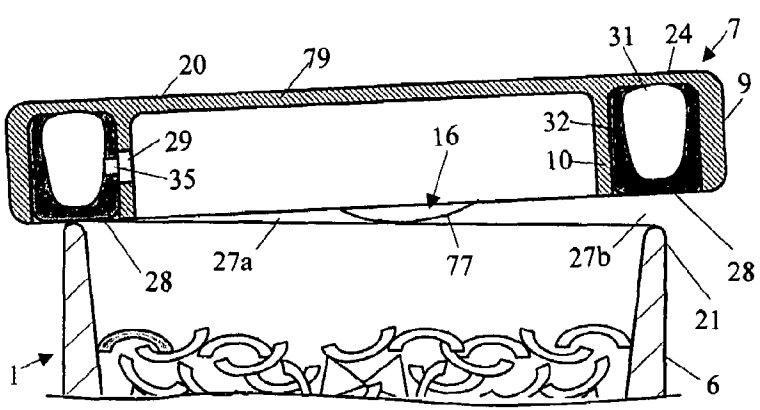
FIG. 5*b* is a section view of the upper part of the device of FIG. 5 when the lid tilts naturally on the dish.
Figure 5:
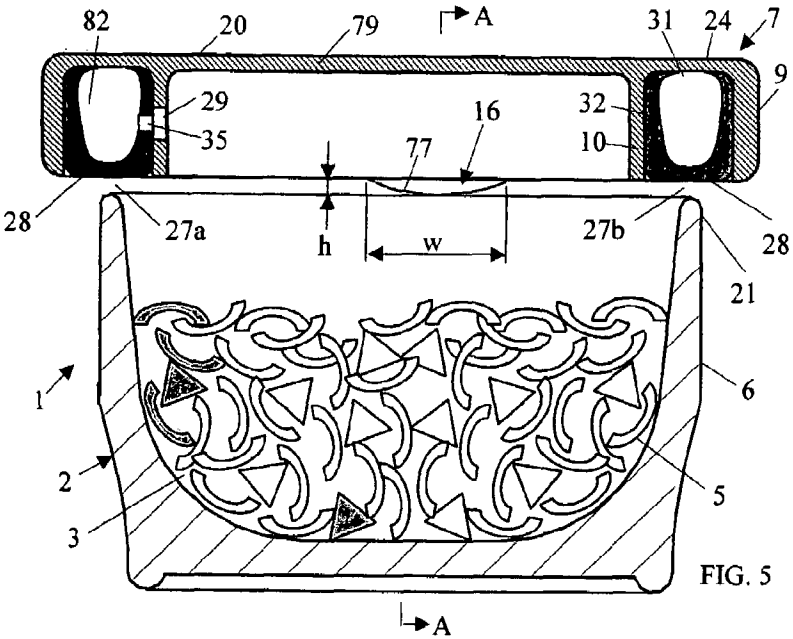
FIG. 5 is a section view of a second modified version for the device of FIG. 3.
Figure 5C:
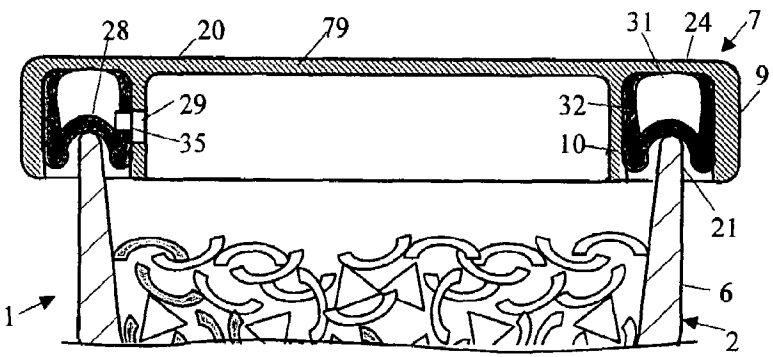
FIG. 5*c* is a section view of the device of FIG. 5 after the lid is pressed by a hand or finger and released.

FIGS. 5-5*c* provide a second modified version to the lid 7 of FIG. 3 that has a sufficiently rigid center section 79 to prevent the sucking-in and crashed food problems after microwave oven heating. In this alternative lid, the elastic membrane 18 is also replaced by a U-shaped seal gasket 32 received in the annular chamber 31. The seal gasket comprises an annular bottom seal section 28, an annular empty chamber 82, a opening 35 in communication with the vacuum facilitating opening 29, and a valve-less air evacuator 16 comprising two protruded sections 77, each having a length w and a height h, on the seal section 28. The two protruded sections 77 sits on the rim 21 of the dish and causes two openings 27*a* and 27*b* to form between the seal section 28 and the rim 21 (FIGS. 5 and 5*a*). The two protruded sections 77 are off centered and located near the right side of the lid, causing the lid to tilt naturally towards the left side on the dish 2 (FIG. 5*b*). It was found that such tilting of the lid on the dish prevents the damage of the lid and the breakage or deformation of the dish after the dish containing wet food is heated in microwave oven.

When the lid 7 is pressed, the openings 27*a* and 27*b* become smaller but still remains sufficiently large (not shown) to allow air to flow out of the dish. The air in the annular chamber 82 is also pressed out through the opening 35, the vacuum facilitating opening 29 and the openings 27*a* and 27*b*. By making the w/h ratio larger than 1 and preferably larger than 5, the openings 27*a* and 27*b* are able to close right after releasing the lid. The elasticity of the gasket 3 tends to push the lid 7 upwards to expand the space between the lid and the dish, thus causing a vacuum to form therein. The closing of the openings 27*a* and 2*b* was found to be sufficient to preserve the vacuum up to several days and even weeks. Since the center section 79 of the lid is sufficiently rigid, this improved lid 7 is not susceptible to the microwave induced sucking-in and crushed food problems.

Another of the problems discovered with the present invention of the vacuum device 1 in FIG. 1 is that the lid 7 is difficult to be removed from the dish 2, especially when most of the air in the dish is removed or expelled. Such difficult-to-remove lid problem was found to be inconvenient to the users. It was also found to cause spill and mess when one tries very hard to remove the lid from a dish that contains soup or other liquid. In case of hot soup, the spill might reach a user's hand and cause potential burning or hurting. FIGS. 6, 6*a*, 6*b* and 6*c* describe a valve-less vacuum releaser 43 for the device 1 to resolving this problem. The releaser 43 comprises a curved-out section 94 on the rigid rim 24, a section of elastic membrane 48 affixed to the curved-out section, and a finger receiving chamber 47 defined by the curved-out section below the section of elastic membrane 48. The finger receiving chamber 47 is large enough to receive a finger or a finger-like member 41 (FIG. 6*c*) to enable the finger to push the elastic membrane upward to generate an air passage for releasing the vacuum. The vacuum release by the finger 41 makes the removal of the lid 7 from the dish spill-free and much less difficult.

Figure 6A:
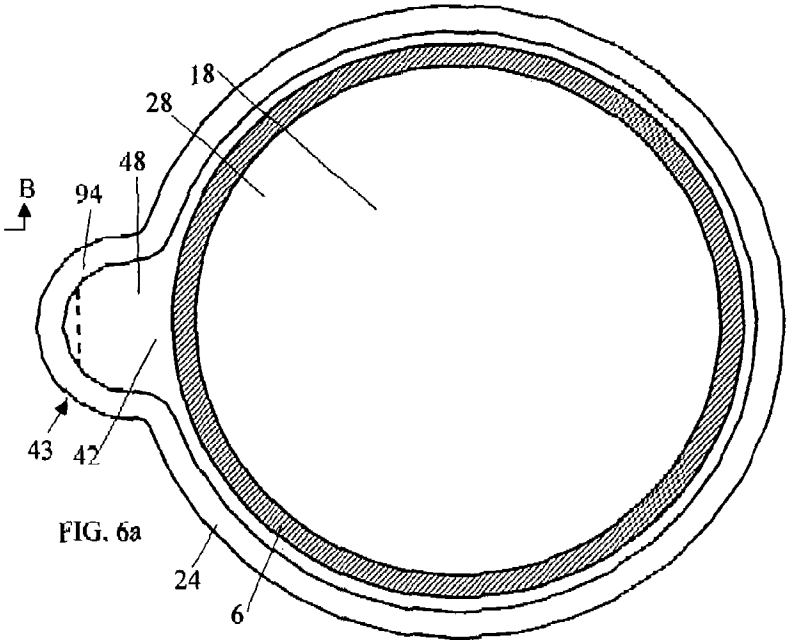
FIG. 6*a* is a section view of the device along line A-A of FIG. 6.
Figure 6C:
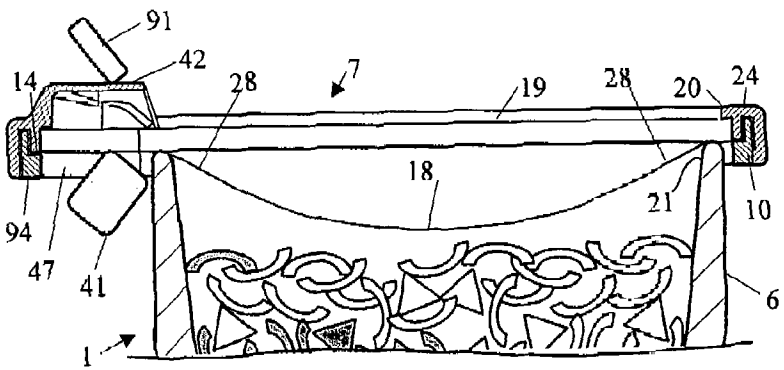
FIG. 6*c* is a section view of the device of FIG. 6*b* after releasing the lid.
Figure 6:
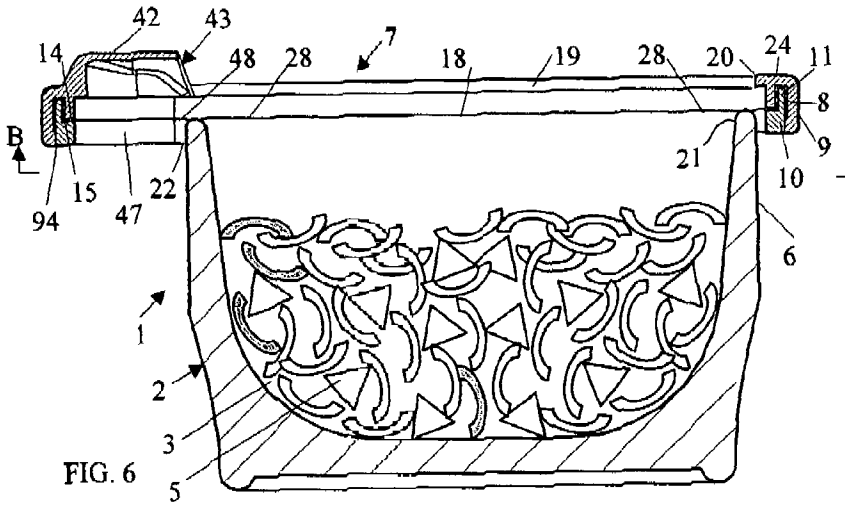
FIG. 6 is a section view of a device having a vacuum lid on a dish before the vacuum is formed according to a third embodiment of the invention.

The valve-less vacuum releaser further has a squeeze enabler 42 formed above the section of elastic membrane 48. The squeeze enabler allows one to place one finger above the enabler and another finger of the same hand below the elastic membrane to squeeze the membrane to release the vacuum in the dish. The enabler 42 can be a thin plate connected to the rigid rim 24 as shown in FIG. 6 or one or more beams (not shown) connected to the rigid rim. It is important the squeeze enabler is positioned sufficiently apart from the section of elastic membrane 48. The distance between the elastic membrane and the enabler should be more than about 2 mm, and is preferably more than 4 mm or 0.16 inches.

The vacuum relief valves in the vacuum food containers taught by the prior art and products such as the FoodSaver® or Seal-a-Meal® vacuum canisters have a small valve opening and a seal member that seals the valve opening during food storage and is manually moved away from the valve opening to release the vacuum prior to removing the lid. Similar to the air extraction valve used in the prior art products, such vacuum relief valves are susceptible to clogging, insufficient closing and bacteria growth problems. The valve-less vacuum releaser 43 has no such valve openings or seal member, and is thus immune to such problems during everyday home uses. It is appreciated that for the very low vacuum that forms in conventional sealed containers when refrigerated or in containers sealed by Amco or Progressive's silicone lids, the lid may be removed by just pushing up the rim or periphery of the lid. It is also appreciated that the valve-less vacuum releaser 43 may used for the lid for the vacuum food canisters and sealed containers.

Figure 6B:
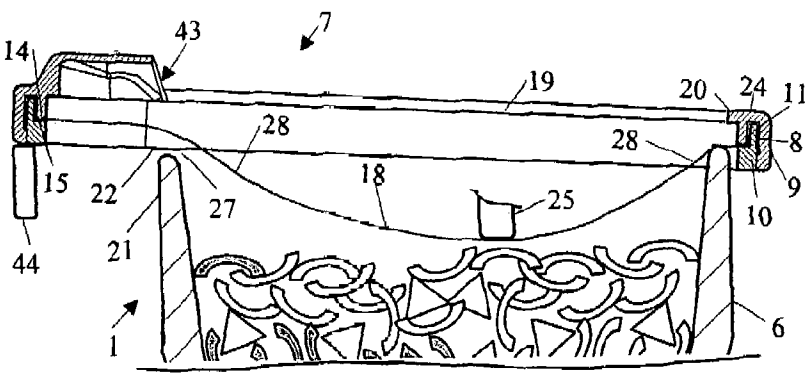
FIG. 6*b* is a section view of the upper part of the device of FIG. 6 when the lid is being pressed by a hand or finger.

During use, it was found that a much deeper vacuum was formed in the dish if the curved-out section 94 of the releaser is lifted or pushed upward slightly by a hand 44 while the elastic membrane 18 is being pressed into the dish by a hand or finger 25 (FIG. 6*b*). It is appreciated that the valve-less vacuum releaser 43 can also be formed on the vacuum lid 7 of the device 1 described in FIGS. 3 to 5. The curved-out section 94 of the releaser 43 is formed on the out rim 9 of the annular chamber 31 and the ring-shaped or annular seal section 28 is extended into the curved-out section 94 to form an elastic section 48 affixed to the curved-out section 94 (not shown).

Figure 7A:
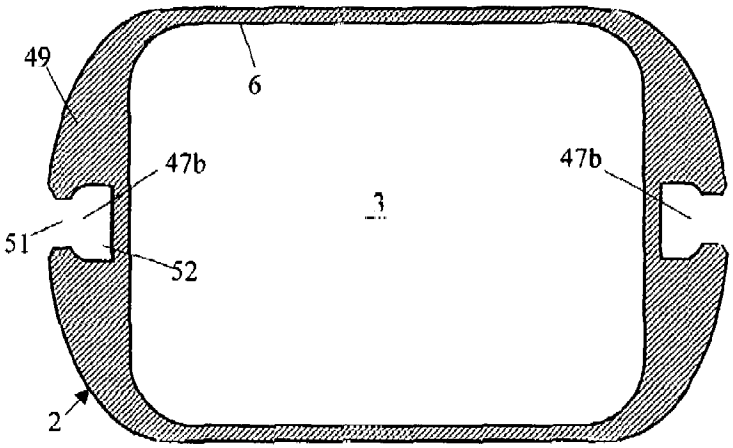
FIG. 7*a* is a section view of the device along line A-A of FIG. 7.
Figure 7B:
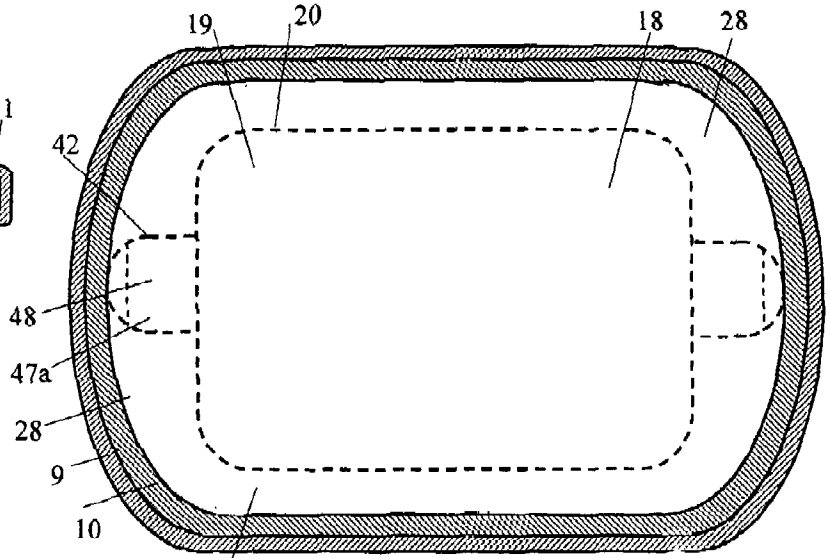
FIG. 7*b* is a section view of the device along line B-B of FIG. 7.
Figure 7:
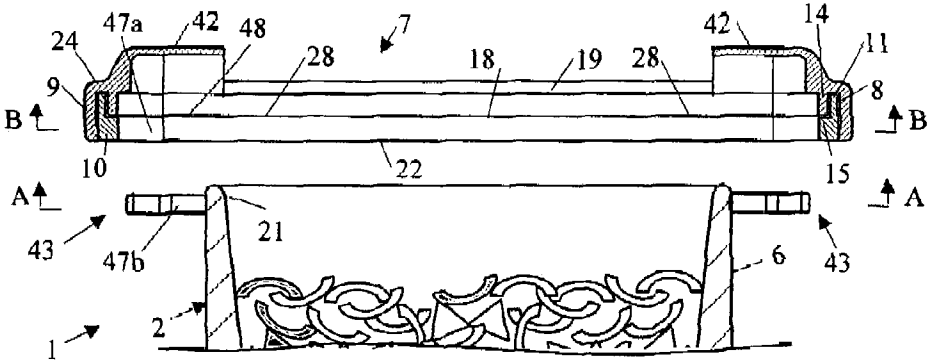
FIG. 7 is a section view of a device having a vacuum lid above a dish before a vacuum is formed according to a forth embodiment of the invention.
Figure 7C:
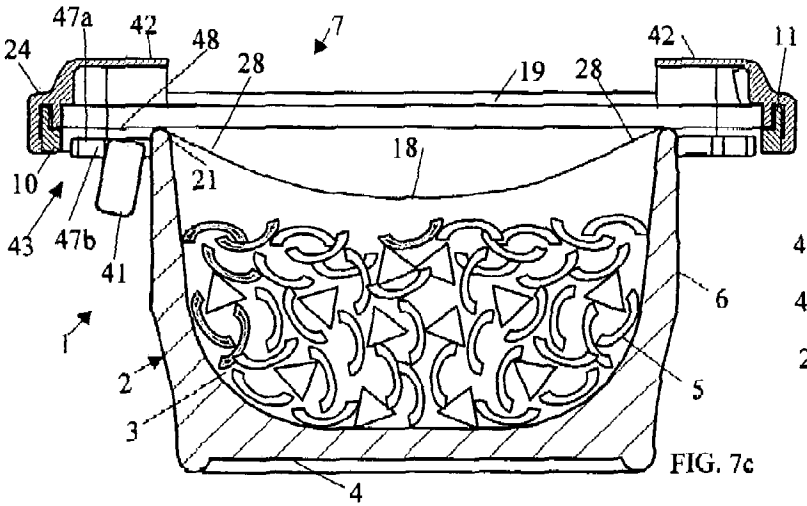
FIG. 7*c* is a section view of the device of FIG. 7 after the lid is pressed by a hand or finger and released.

FIGS. 7, 7*a*, 7*b* and 7*c* describe a first modified version of the valve-less vacuum releaser 43 for the vacuum lid 7. The device 1 has a rectangular dish 2 and a rectangular vacuum lid 7 having a rectangular elastic membrane 18 affixed to the rigid rim 28 of the lid and two valve-less vacuum releasers 43, one on the left and the other on the right side of the lid. The lower opening 22 of the lid 7 is dimensioned to receive the rim 21 and the two handles 49 of the dish 2. Each valve-less vacuum releaser 43 comprises a first finger-receiving chamber 47*b* in a handle 49 of the dish 2, a section of elastic membrane 48 above the first finger-receiving chamber 47*b*, a second finger-receiving chamber 47*a* below the section of elastic membrane 48 in the lid 7, and squeeze enabling plate 42. The squeeze plate 42 is located a predetermined distance above the upper horizontal ring 20 formed on the outer rim 9 (FIGS. 7 and 7*b*). The first finger-receiving chamber 47*b* has an inner chamber 52 and an outer opening 51 (FIG. 7*a*) sufficiently large to allow a finger 41 to pass through to reach the second finger-receiving chamber 47*a* and the section of elastic membrane 48 to push the elastic membrane to release the vacuum in the dish (FIG. 7*c*).

Figure 8B:
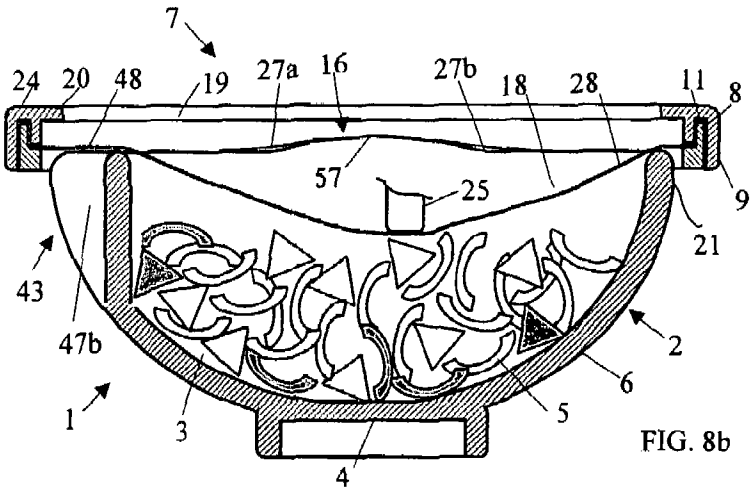
FIG. 8*b* is a section of the device of FIG. 8 when the lid is being pressed by a hand or finger.
Figure 8C:
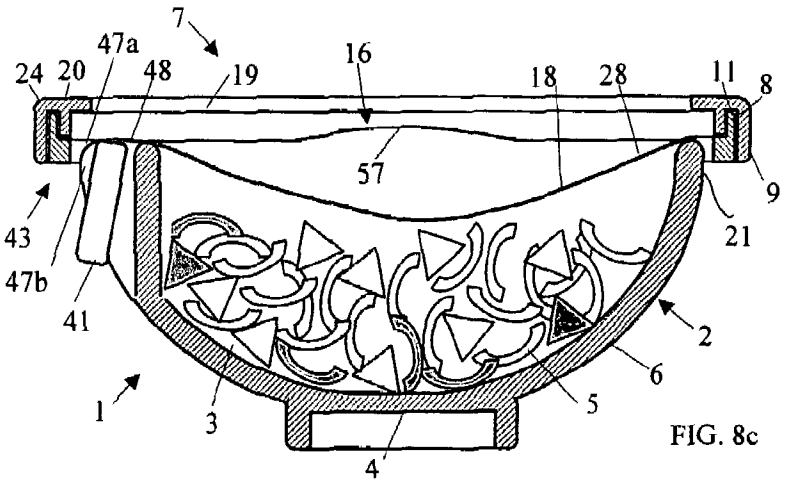
FIG. 8*c* is a section view of the device of FIG. 8*b* after releasing the lid.
Figure 8:
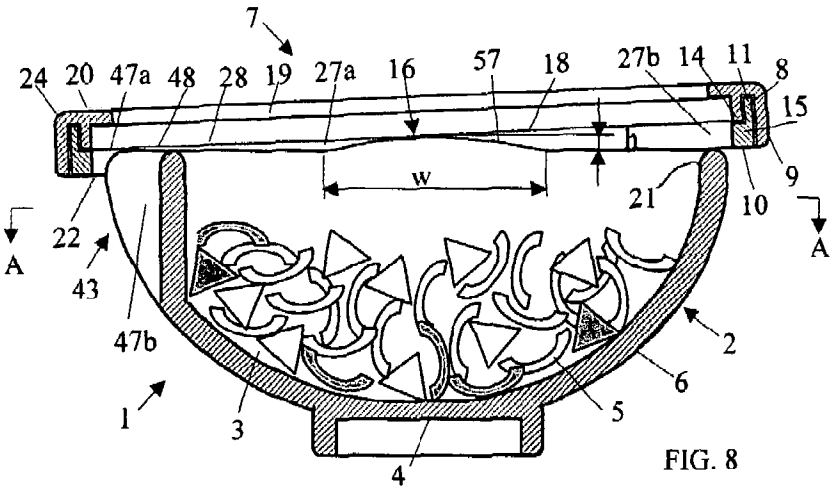
FIG. 8 is a section view of a device having a vacuum lid on a dish before a vacuum is formed according to a fifth embodiment of the invention.
Figure 8A:
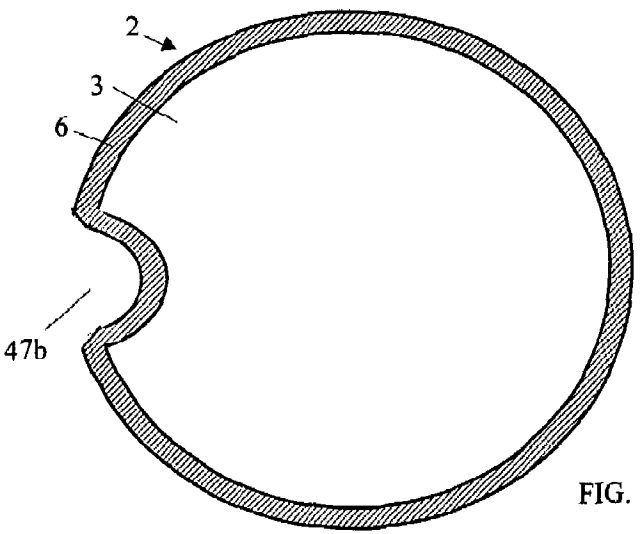
FIG. 8*a* is a section view of the device along line A-A of FIG. 8 without showing the food in the dish.

FIGS. 8, 8*a*, 8*b* and 8*c* describe a second modified version of the valve-less vacuum releaser 43 for a round vacuum lid 7 comprising a round elastic membrane 18 with its peripheral section 28 affixed to the rigid rim 24 similar to that described in FIG. 1. The valve-less vacuum releaser 43 comprises a finger-receiving chamber 47 formed by curving or recessing the side wall 6 of the dish 2 and the section of elastic membrane 48 above the finger receiving chamber (FIGS. 8 and 8*a*). The chamber 47 is sufficiently large to receive a finger or finger-like member 41 to allow the finger to push the section of elastic membrane 48 to release the vacuum in the dish (FIG. 8*c*). In this preferred embodiment, the part of the upper horizontal ring 20 located a predetermined distance above the section of elastic membrane 48 could function as the squeeze enabler 43 to facilitate the release of the vacuum in the dish 2.

A protruded section 57 is provided on the front part and another protruded section 57 on the back part of the rim 21 of the dish 2 to form openings 27*a* on the left and openings 27*b* on the right side of the protruded sections 57. Both the front and back protruded sections 57 are positioned near the right part of the dish to cause the lid 7 to tilt towards the left side to make openings 27*b* significantly larger than openings 27*a* for preventing the microwave induced sucking-in and crushed food problems discussed earlier for the device 1 of FIG. 1. The openings 27*a* and 27*b* also functions as the valve-less air evacuator 16 that enables air in the dish to be evacuated when a hand or finger 25 presses the elastic membrane 18 of the lid into the dish (FIG. 8*b*) and enable sufficient closing of the openings 27*a* and 27*b* after releasing the lid to preserve the vacuum formed in the dish 2 (FIG. 8*c*).

Another of the problems discovered with the present invention of the vacuum device 1 in FIG. 1 is the loss of vacuum in the dish 2 after an extended period of storage in freezer and refrigerator. Such loss of vacuum was initially thought due to the presence of the valve-less air evacuator 16. Later studies found that the vacuum disappeared in several days and sometimes in half a day even if the valve-less air evacuator was intentionally removed from the device 1. Such vacuum loss in the dish was found to occur with various elastic membranes such as butyl rubber, ethylene acrylic elastomers, ethylene propylene (or EPDM) rubber, polyurethane elastomers and natural rubber membranes. Although the reason for such vacuum loss was still not understood, it was discovered, quite by accident, that if the elastic membrane 18 was thinned about 12% compared to the membrane's original thickness, the loss of vacuum in the dish 2 was prevented or at least significantly reduced. In several long-term storage tests, it was found that the vacuum lid 7 comprising an elastic membrane 18 that was thinned about 12% could maintain the vacuum in the dish for six months to a year. In comparable tests with the same elastic membrane but with the membrane not thinned in the vacuum lid 7, the vacuumed in the dish 2 lasted only several days.

Figure 9:
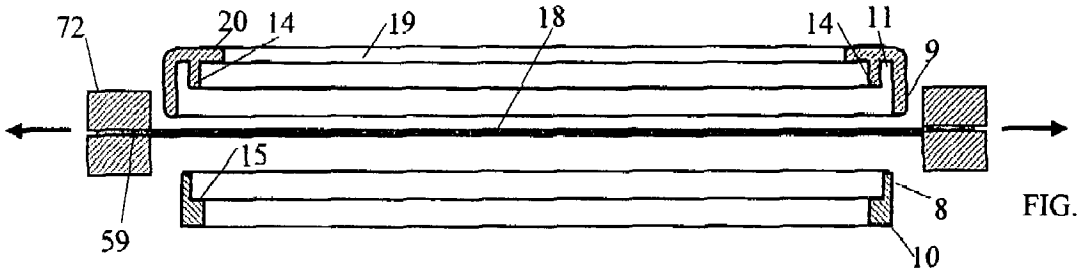
FIG. 9 is a section view of the outer rigid rim, inner rim and the membrane of the lid of FIG. 8 before affixed between the upper and lower rigid rims.
Figure 9A:
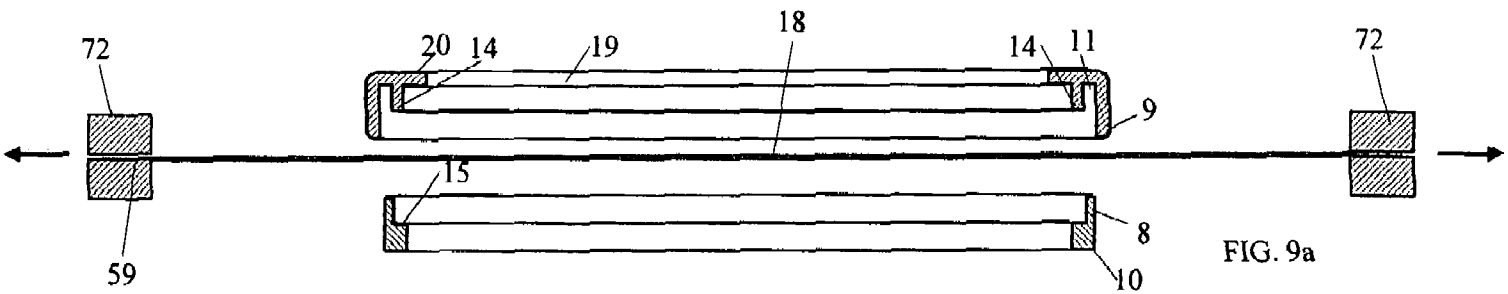
FIG. 9*a* is a section view of the outer rigid rim, inner rim and the membrane that is being thinned about 30% to prevent loss of vacuum.
Figure 9B:
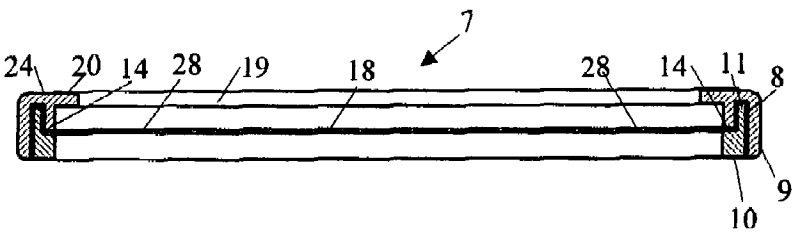
FIG. 9*b* is a section view of the upper rigid rim, inner d rim and the thinned membrane after the thinned membrane is affixed between the outer and inner rims.

FIGS. 9*a-c* shows the thinning process for the elastic membrane 18 before affixing it to the rigid rim 24. Before the thinning, the elastic membrane 18 was thick and its peripheral edge was clamped by clamp 72 (FIG. 9). The elastic membrane was placed between the outer rigid rim 9 and inner rim 10. FIG. 9*b* shows the elastic membrane 18 after the membrane was thinned about 25% by stretching the elastic membrane 18 with the clamp 72. FIG. 9*c* shows the vacuum lid 7 with the thinned elastic membrane sandwiched between the inner and outer rims 9 an 10. The inner rim 10 is prevented from separating from the outer rim 9 by the annular channel 11 in the outer rim 9 and the ridge 8 on the inner rim 10, where the thickness of the ridge 8 plus two times of the thickness of the thinned elastic membrane is larger than the gap for annular channel 11. To prevent the vacuum loss in the dish 2 when stored in refrigerator or freezer, the thinning of the elastic membrane 18 in the vacuum lid should be about 3% or more depending on the nature and original thickness of the elastic membrane, and be preferably more than 8% prior to affixing the membrane to the rigid rim 24.

It was found that after the lid 7 was used to generate and maintain vacuum in the container one or more times, the lid gradually lost its capability to generate and maintain sufficient vacuum for the perishable product. It was further found that the lid's capability to generate and maintain vacuum could be restored, at least partially, by exposing the lid to a hot fluid such as hot water having a temperature higher than 45° C. for about 10 seconds to several minutes. Higher hot fluid temperature up to 95° C. and longer exposing time was found to restore the lid's vacuum generating and maintaining capability in some cases more effectively.

It was discovered that although a vacuum lid 7 with its elastic membrane 18 thinned as much as 10% could maintain the vacuum in the dish 2 for several weeks to months in freezer or refrigerator, the same vacuum lid could not maintain the vacuum in the dish for more than one or two days in the same refrigerator or freezer after the dish covered by the vacuum lid was heated in microwave oven once or twice. It is believed that the microwave caused certain structural or compositional changes in the thinned elastic membrane 8 that is detrimental to the preservation of the vacuum between the dish 2 and the vacuum lid 7. Various protections for the elastic membrane, such as covering the elastic membrane by a plastic wrap films and even perforated aluminum foils, were found not effective in preventing such microwave-induced vacuum loss in the dish 2. It was discovered that the vacuum loss, however, could be prevented by thinning the elastic membrane more than 15%, preferably more than 25% before affixing the elastic membrane to the rigid rim 24.

The scope of the invention is obviously not restricted or limited to the embodiments described by way of examples and depicted in the drawings, there being numerous changes, modifications, additions, and applications thereof imaginable within the purview of the claims.

What is claimed is:

1. vacuum generating device for sealing a perishable product comprising:

a lid for a container adapted to receive the perishable product, said lid comprising an elastic seal member for forming an airtight seal to the rim of the container, said elastic seal member being substantially impermeable to air to prevent air from permeating through into the container, and a rigid rim connected to said elastic seal member for receiving or surrounding the rim of the container, said rigid rim comprising a sufficiently rigid material for preventing said rigid rim from being substantially deformed when said lid is pressed to deform said elastic seal member to force air out of the container and for forming and preserving vacuum in the container after said lid is released, the rigid rim substantially defining a plane and including an outwardly protruding section;

a valve-less vacuum releaser for releasing the vacuum in the container to facilitate the removal of said lid, said valve-less vacuum releaser comprising a finger-receiving chamber defined by the outwardly protruding section and disposed generally below a section of said elastic seal member located within the outwardly protruding section, said finger-receiving chamber being sufficiently large to allow a finger or finger-like member to press onto and push said section of said elastic seal member to release the vacuum in the container; and whereby in use, to form a vacuum in the container one presses said lid to force the air out of the container and subsequently releases said lid, and to open the container one places a finger or finger-like member into said finger-receiving chamber and pushes said elastic seal member to release said vacuum in the container.

2. A vacuum generating device as defined in claim 1 wherein said valve-less vacuum releaser further comprises a squeeze-enabler connected to said rigid rim, the squeeze-enabler extending over and being spaced a predetermined distance above said section of said elastic seal member, thereby enabling one to place a finger on said squeeze-enabler and another finger in said finger-receiving chamber underneath said section of said elastic membrane and to squeeze to release the vacuum in the container.

3. A vacuum generating device as defined in claim 2 wherein said squeeze-enabler is connected to said outwardly protruding section of said rigid rim.

4. A vacuum generating device as defined in claim 2 wherein said squeeze-enabler comprises a plate connected to the rigid rim.

5. A vacuum generating device as defined in claim 1 wherein said rigid rim comprises a horizontal ring that includes an inwardly extending ridge that is spaced above the elastic seal member.

6. A vacuum generating device as defined in claim 1 wherein said elastic seal member comprises an elastic membrane having a peripheral section affixed to said rigid rim.

7. A vacuum generating device as defined in claim 1 wherein the rigid rim is substantially circular.

8. A vacuum generating device as defined in claim 1 wherein the rigid rim is substantially rectangular.

9. A vacuum generating device as defined in claim 1 further comprising a valve-less air evacuator formed between a section of said seal member and the rim of the container, said air evacuator allowing the air to flow out of the container when said lid is being pressed and becoming closed when said lid is released to form the vacuum.

10. A vacuum generating device as defined in claim 9 wherein said valve-less air evacuator comprises a portion of said seal member that is sufficiently more deformable than the rest of said seal member to enable an air passage to form between said portion of said seal member and the rim of the container as said lid is being pressed.

11. A vacuum generating device as defined in claim 9 wherein said valve-less air evacuator comprises at least one of a protruded section and a recessed section for said seal member to form at least one opening between said seal member and the rim of the container to allow air to flow out of the container as said lid is being pressed, said seal member being sufficiently elastic and thin to close said at least one opening upon release of the lid to form said vacuum.

12. A vacuum generating device as defined in claim 1 wherein said lid further comprises a sufficiently rigid center section connected to said rigid rim to prevent the center portion from being sucked into the container by the vacuum.

13. A vacuum generating device as defined in claim 12 wherein said rigid rim further includes an inner rim and an outer rim, said elastic seal member being connected to said inner and outer rims to form an annular seal section for sealing the rim of the container.

14. A vacuum generating device as defined in claim 13 further comprising an air passage way for an annular chamber defined by said inner rim, outer rim and annual seal section to prevent air pressure to form above said above said annual seal section.

15. A vacuum generating device as defined in claim 12 wherein said elastic seal member comprises a seal gasket receivable by said rigid rim, said seal gasket having an annular bottom seal section for sealing the rim of the container.

16. A vacuum generating device as defined in claim 15 wherein said seal gasket further comprises an annular chamber or channel above said annular bottom seal section and said lid further comprises a passageway for the air in said annular chamber or channel to exit when said lid is being pressed, thereby facilitating the movement of said annular bottom seal section.

17. A vacuum generating device as defined in claim 15 wherein said annular bottom seal section of said seal gasket extends at least to the lower end of said rigid rim of said lid.

18. A vacuum generating device for sealing a perishable product comprising, a lid for a container adapted to receive a perishable product, said lid comprising an elastic membrane for sealing to the rim of the container, said elastic membrane being substantially impermeable to air to prevent air from permeating through into the container, and a rigid rim connected to the peripheral section of said elastic membrane, said rigid rim comprising a sufficiently rigid material to prevent it from being substantially deformed when said elastic membrane is pressed into the container to force the air out of the container: and wherein said elastic membrane is held by the rigid rim under sufficient tension when the rim is not applied to the container to maintain the elastic membrane in a stretched condition, wherein in the stretched condition the thickness of the elastic membrane is reduced as compared with the thickness of the elastic membrane when not in a stretched condition; and wherein in the stretched condition the thickness of the elastic membrane is reduced by at least 3% as compared with the thickness of the elastic membrane when not in a stretched condition

19. A vacuum generating device as defined in claim 18 wherein in the stretched condition the thickness of the elastic membrane is reduced by at least 8% as compared with the thickness of the elastic membrane when not in a stretched condition.

20. A vacuum generating device as defined in claim 19 wherein said rigid rim comprises a first rigid rim and a second rim, wherein during the assembly of said lid said elastic membrane is sandwiched between said first and second rims and is stretched to reduce its thickness by said at least 3% as compared with the thickness of the elastic membrane in its original thick and non-stretched condition prior to the assembly.

21. A vacuum generating device as defined in claim 20 wherein said second rim has a ridge and said first rim has an annular channel for receiving said ridge, the thickness of said ridge plus two times of the thickness of said elastic membrane at its stretched or thinned state being larger than the gap for said annular channel, thereby preventing the separation of said first and second rims and maintaining said elastic membrane in the stretched condition during the storage of said lid in its unused state.

22. A vacuum generating device as defined in claim 19 wherein during the assembly of said lid, said elastic membrane is stretched to reduce its thickness by said at least 3% as compared with the thickness of the elastic membrane in its original thick and non-stretched condition prior to the assembly and is affixed to said rigid rim, thereby maintaining said elastic membrane in the stretched condition when said lid is in its unused state.

23. A vacuum generating device as defined in claim 19 further comprising a valve-less vacuum releaser for releasing the vacuum in the container to facilitate the removal of said lid, said vacuum releaser comprising an outwardly protruding section of said rigid rim and a section of said elastic membrane located within the outwardly protruding section, said outwardly protruding section being sufficiently large to allow a finger or finger-like member to press onto and push said section of said elastic membrane to release the vacuum in the container.

24. A vacuum generating device as defined in claim 19 further comprising a valve-less vacuum releaser for facilitating the removal of said lid, said vacuum releaser comprising at least one of a beam and a plate connected to said rigid rim and extending over a section of said elastic membrane above the rim of the container to facilitate the release of the vacuum in the container.

25. A vacuum generating device as defined in claim 19 wherein said rigid rim comprises an annular ring having an inwardly extending ridge that is spaced above the elastic membrane.

26. A vacuum generating device as defined in claim 19 further comprising a valve-less air evacuator formed between a section of said elastic membrane and the rim of the container, said air evacuator allowing the air to flow out of the container when said lid is being pressed and becoming closed when said lid is released to cause vacuum to form in the container.

27. A method for using the vacuum generating device as defined in claim 19 comprising a step of exposing said lid to hot liquid to restore, at least partially, the lid's capability to maintain the vacuum for the perishable product in the container.

* * * * *

UNITED STATES PATENT AND TRADEMARK OFFICE

CERTIFICATE OF CORRECTION

PATENT NO. : 7,594,586 B2
APPLICATION NO. : 11/499280
DATED : September 29, 2009
INVENTOR(S) : Cai It is certified that error appears in the above-identified patent and that said Letters Patent is hereby corrected as shown below:

Col. 12 lines 63-67 and Col. 13 lines 1-3 should read 20. (Corrected) A vacuum generating device as defined in claim [[19]] 18 wherein said rigid rim comprises a first rigid rim and a second rim, wherein during the assembly of said lid said elastic membrane is sandwiched between said first and second rims and is stretched to reduce its thickness by said at least 3% as compared with the thickness of the elastic membrane in its original thick and non-stretched condition prior to the assembly.

Col. 13 lines 13-20 should read 22. (Corrected) A vacuum generating device as defined in claim [[19]] 18 wherein during the assembly of said lid, said elastic membrane is stretched to reduce its thickness by said at least 3% as compared with the thickness of the elastic membrane in its original thick and non-stretched condition prior to the assembly and is affixed to said rigid rim, thereby maintaining said elastic membrane in the stretched condition when said lid is in its unused state.

Col. 13 lines 21-28 and Col. 14 lines 1-3 should read 23. (Corrected) A vacuum generating device as defined in claim [[19]] 18 further comprising a valve-less vacuum releaser for releasing the vacuum in the container to facilitate the removal of said lid, said vacuum releaser comprising an outwardly protruding section of said rigid rim and a section of said elastic membrane located within the outwardly protruding section, said outwardly protruding section being sufficiently large to allow a finger or finger-like member to press onto and push said section of said elastic membrane to release the vacuum in the container.

Col. 14 lines 4-10 should read 24. (Corrected) A vacuum generating device as defined in claim [[19]] 18 further comprising a valve-less vacuum releaser for facilitating the removal of said lid, said vacuum releaser comprising at least one of a beam and a plate connected to said rigid rim and extending over a section of said elastic membrane above the rim of the container to facilitate the release of the vacuum in the container.

Signed and Sealed this
Twenty-third Day of August, 2011

David J. Kappos

David J. Kappos
*Director of the United States Patent and Trademark Office*

Col. 14 lines 11-14 should read 25. (Corrected) A vacuum generating device as defined in claim [[19]] 18 wherein said rigid rim comprises an annular ring having an inwardly extending ridge that is spaced above the elastic membrane.

Col. 14 lines 15-21 should read 26. (Corrected) A vacuum generating device as defined in claim [[19]] 18 further comprising a valve-less air evacuator formed between a section of said elastic membrane and the rim of the container, said air evacuator allowing the air to flow out of the container when said lid is being pressed and becoming closed when said lid is released to cause vacuum to form in the container.

Col. 14 lines 22-26 should read 27. (Corrected) A method for using the vacuum generating device as defined in claim [[19]] 18 comprising a step of exposing said lid to hot liquid to restore, at least partially, the lid's capability to maintain the vacuum for the perishable product in the container.